US010605030B1

(12) United States Patent
Baugh et al.

(10) Patent No.: US 10,605,030 B1
(45) Date of Patent: Mar. 31, 2020

(54) HYDRAULICALLY ACTIVATED CONNECTION DEVICE

(71) Applicants: Benton Frederick Baugh, Houston, TX (US); Christopher David Rekieta, Houston, TX (US); Nathan Schmidt, Houston, TX (US); James Mlodzianowski, Houston, TX (US); Stephanie Tritchler, Houston, TX (US)

(72) Inventors: Benton Frederick Baugh, Houston, TX (US); Christopher David Rekieta, Houston, TX (US); Nathan Schmidt, Houston, TX (US); James Mlodzianowski, Houston, TX (US); Stephanie Tritchler, Houston, TX (US)

(73) Assignee: Reel Power Licensing Corp., Oklahoma CIty, OK (US)

( * ) Notice: Subject to any disclaimer, the term of this patent is extended or adjusted under 35 U.S.C. 154(b) by 103 days.

(21) Appl. No.: 15/728,020

(22) Filed: Oct. 9, 2017

Related U.S. Application Data

(60) Provisional application No. 62/406,043, filed on Oct. 10, 2016.

(51) Int. Cl.

| | |
|---|---|
| ***E21B 33/03*** | (2006.01) |
| ***E21B 34/02*** | (2006.01) |
| ***E21B 43/26*** | (2006.01) |
| ***E21B 19/16*** | (2006.01) |
| ***E21B 29/12*** | (2006.01) |
| ***E21B 33/038*** | (2006.01) |
| *E21B 43/12* | (2006.01) |

(52) U.S. Cl.
CPC ..... *E21B 33/03* (2013.01); *E21B 34/02* (2013.01); *E21B 43/126* (2013.01)

(58) Field of Classification Search
CPC ..... E21B 19/16; E21B 19/00; E21B 33/038; E21B 29/12; E21B 41/04
See application file for complete search history.

(56) References Cited

U.S. PATENT DOCUMENTS

| | | | | |
|---|---|---|---|---|
| 1,511,541 | A * | 10/1924 | Thompson | F03B 1/00 241/191 |
| 3,292,695 | A * | 12/1966 | Haeber | E21B 41/04 114/257 |
| 3,633,667 | A * | 1/1972 | Falkner, Jr. | E21B 33/035 166/363 |
| 5,509,575 | A * | 4/1996 | Gillette | G01F 11/024 222/1 |
| 2016/0281473 | A1 * | 9/2016 | Delgado | E21B 43/013 |

* cited by examiner

*Primary Examiner* — David J Bagnell
*Assistant Examiner* — Manuel C Portocarrero
(74) *Attorney, Agent, or Firm* — Phillips Murrah PC; Martin G. Ozinga

(57) ABSTRACT

The present invention provides an improved hydraulically activated clamping device for connecting a wellhead and or Christmas tree positioned on a wellhead to a fracing tree that may comprise a connector body; a mandrel body; two or more clamp segments; two or more actuating bolts; a seal ring to provide sealing engagement between said connector body and said mandrel body; one or more motors driving each of said two or more actuating bolts; and control means to reduce or retard the power to the first of said two or more actuating bolts to release and prevent its further movement until the other of said actuating bolts release also.

6 Claims, 22 Drawing Sheets

10

10

10

10

10

10

MADE-UP CONDTION
(FLEXED/BENT)

AS-MACHINED CONDITION
(UNFLEXED/UNBENT)

fig 20B
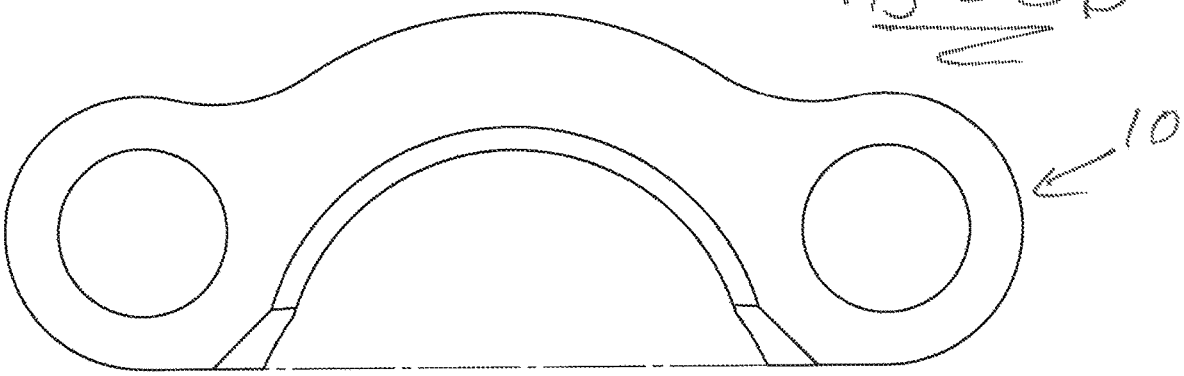
FIG. 8
fig 20C MADE-UP CONDTION
(FLEXED/BENT)
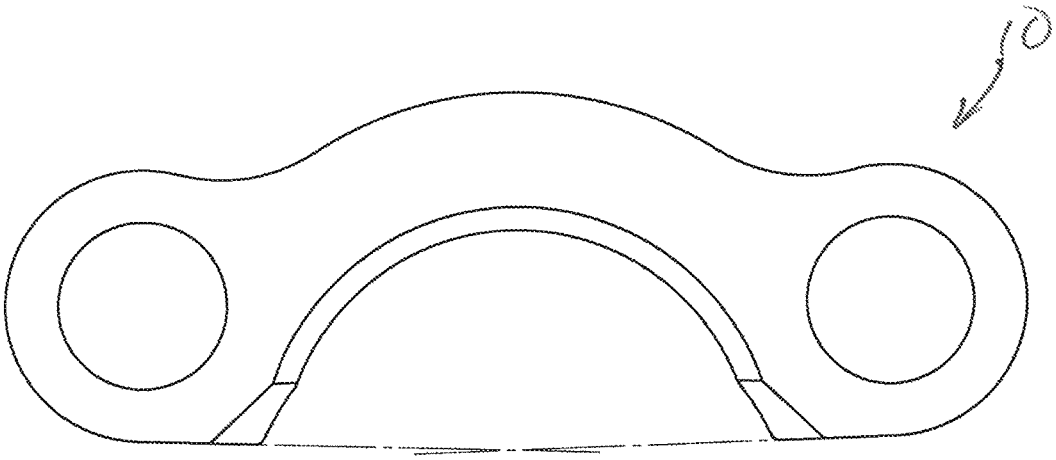
FIG. 9
AS-MACHINED CONDITION
(UNFLEXED/UNBENT)

10

10

HYDRAULICALLY ACTIVATED CONNECTION DEVICE

CROSS-REFERENCE TO RELATED APPLICATIONS

Priority is claimed from U.S. Provisional Application Ser. No. 62/406,043 filed on Oct. 10, 2016 and incorporated by reference herein.

BACKGROUND OF INVENTION

1. Field of the Invention

In general, the present invention relates to a device, system and method for connecting a conduit to a wellhead bore. More particularly, the present invention provides an improved hydraulically activated clamping device for connecting a wellhead and or Christmas tree positioned on a wellhead to a fracing tree.

2. Description of the Prior Art

Once drilling and casing are completed, a wellhead is attached for providing the structural and pressure-containing interface for the drilling and production equipment. Wellheads are typically welded onto the first string of casing, which has been cemented in place during drilling operations, to form an integral structure of the well. The surface pressure control may be provided by a Christmas tree, which is installed on top of the wellhead, with isolation valves and choke equipment to control the flow of well fluids during production. It is understood that not all wells utilize Christmas trees.

Fracturing, also referred to as fracing, is the pumping of high volumes of fluid into oil and gas wells at high pressure to fracture the formation and facilitate improved flow. The permanent equipment at the oil or gas well is either the wellhead assembly, which supports the casing, or the wellhead assembly with a Christmas tree landed on the top of it. Fracing is pumping this fluid in the well and thereby into the formations through this permanent equipment.

Fracing is generally done through an assembly of valves and fitting landed on top of the permanent equipment. This assembly of valves and fittings is called a fracing tree. The fracing tree is conventionally connected with an API industry standard flange, which requires making up 12-16 high capacity bolts one at a time, a process that will take from 15-30 minutes of intense labor each time the fracing tree is installed or removed. As fracing implies a large quantity of fluids available for pumping and large expensive high capacity pumps, waiting time for this fleet of equipment and supplies is expensive.

This loss of time has been repeated countless times over the years by industry experts who understand that this is simply what needs to be done. Thus, there is a need for an apparatus, process and or system that provides quick and reliable means for securing equipment such as but not limited to a fracing tree to a wellhead and or Christmas tree previously attached to a wellhead. The above discussed limitations in the prior art is not exhaustive. The current invention provides an inexpensive, time saving, more reliable apparatus, method and system where the prior art fails.

SUMMARY OF THE INVENTION

In view of the foregoing disadvantages inherent in the known types of conventional connections now present in the prior art, the present invention provides a new and improved apparatus, system, and method of use that provides faster and safe performance. As such, the general purpose of the present invention, which will be described subsequently in greater detail, is to provide a new and improved hydraulic connector for use with a wellhead and or Christmas tree previously attached to a wellhead, which has all the advantages of the prior art devices and none of the disadvantages.

It is, therefore, contemplated that the present invention is an apparatus, system and method for connecting oilfield pressure vessels, comprising a connector body; a mandrel body;

two or more clamp segments; two or more actuating bolts; a seal ring to provide sealing engagement between said connector body and said mandrel body; one or more motors driving each of said two or more actuating bolts; and control means to reduce or retard the power to the first of said two or more actuating bolts to release and prevent its further movement until the other of said actuating bolts release also.

There has thus been outlined, rather broadly, the more important features of the invention in order that the detailed description thereof that follows may be better understood and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in this application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting. As such, those skilled in the art will appreciate that the conception upon which this disclosure is based may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

Therefore, it is an object of the present invention to provide a new and improved hydraulically activated connector apparatus, system and method for use with a wellhead and or Christmas tree previously installed on a wellhead to other equipment such as but not limited to a fracing tree.

Furthermore, an object of the present invention is to provide a new and improved hydraulically activated connector apparatus, system and method, which allows for transmitting fluids at high pressure from a fracing tree to a well via wellhead and or Christmas tree previously attached to the wellhead.

Another object of the present invention is to provide a new and improved hydraulically activated connector, which may provide a hydraulic means for securing two pressure vessels without the need for bolts.

It is a further object of the present invention to provide a new and improved hydraulically activated connector apparatus, system and method, which is of a durable and reliable construction and may be utilized in numerous types of wellhead applications and or Christmas tree applications.

An even further object of the present invention is to provide a new and improved hydraulically activated connector apparatus, system and method, which is susceptible to a low cost of installation and labor, which accordingly is then susceptible to low prices of sale to the consuming industry, thereby making such a system economically available to those in the field.

Still another object of the present invention is to provide a new and improved hydraulically activated connector, which provides all of the advantages of the prior art while simultaneously overcoming some of the disadvantages normally associated therewith.

These, together with other objects of the invention, along with the various features of novelty, which characterize the invention, are pointed out with particularity in the claims annexed to and forming a part of this disclosure. For a better understanding of the invention, its operating advantages, and the specific objects attained by its uses, reference should be had to the accompanying drawings and descriptive matter in which there are illustrated preferred embodiments of the invention.

BRIEF DESCRIPTION OF THE PICTORIAL ILLUSTRATIONS, GRAPHS, DRAWINGS, AND APPENDICES

The invention will be better understood and objects other than those set forth above will become apparent when consideration is given to the following detailed description thereof. Such description makes reference to the annexed pictorial illustrations, graphs, drawings and appendices.

FIGS. 12 through 24 are generally other preferred embodiments in accordance with the current invention wherein the actuation is hydraulically actuated cylinders that drive linkages that then move the clamp halves.

DETAILED DESCRIPTION OF INVENTION

Figure 1:
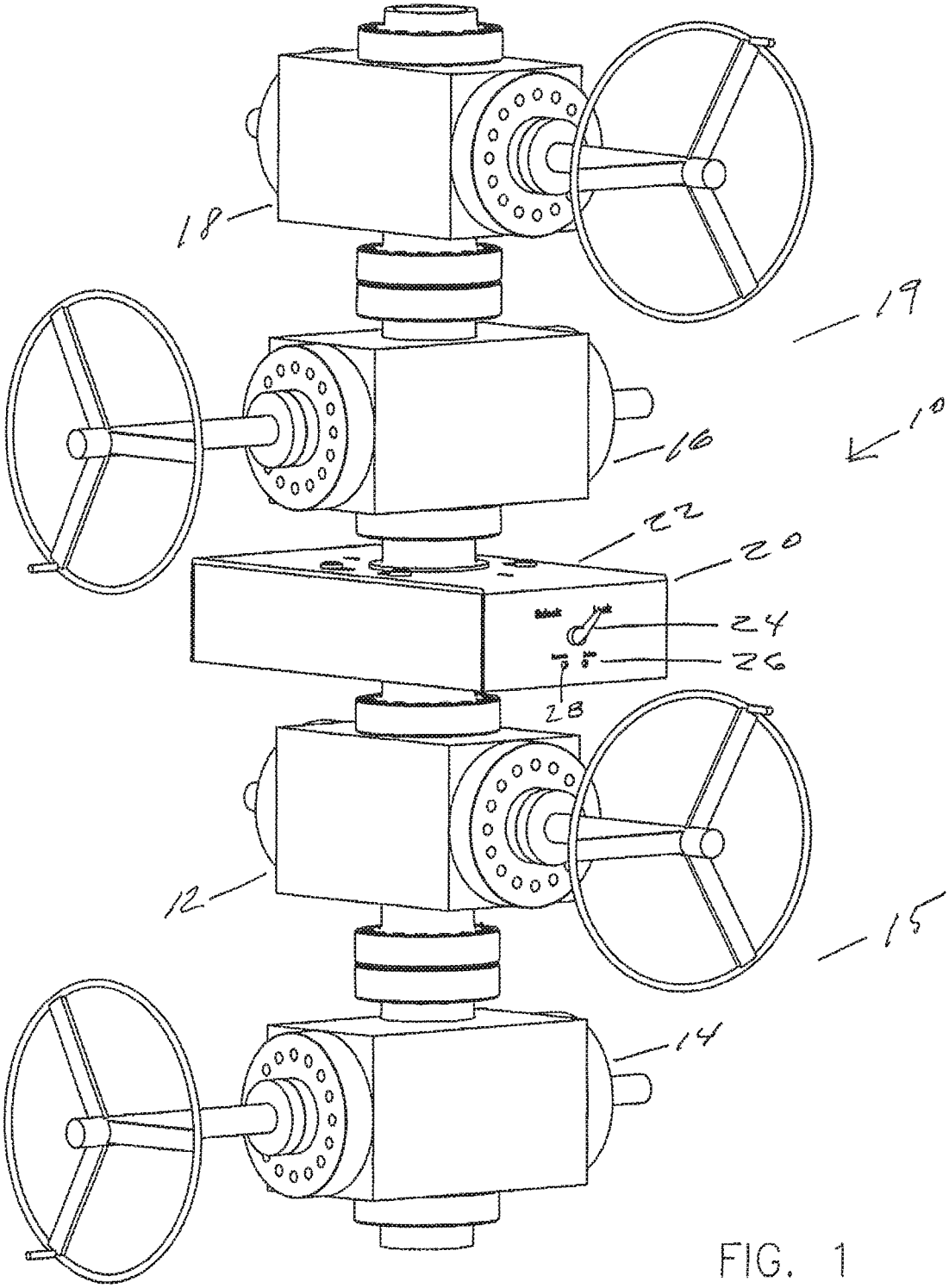
FIG. 1 is generally a perspective view of a pair of valves illustrating a portion of a fracing tree on a pair of valves indicating a portion of a Christmas tree with a connector placed between them in accordance with a preferred embodiment of the current invention.

Referring to the illustrations, drawings, and pictures, and to FIG. 1 in particular, reference character 10 generally designates a new and improved hydraulically activated connector in accordance with the present invention. Invention 10 is generally used in oil and gas well operations and may be utilized in other operations not associated with oil and gas operations. For purposes of convenience, the reference numeral 10 may generally be utilized for the indication of the invention, portion of the invention, preferred embodiments of the invention and so on. It is also to be understood that invention 10 should not be considered limited to just a "hydraulically activated connector" and the term should not be considered to limit the invention to such.

Referring now to FIG. 1, a portion of the equipment located on the wellhead at a fracing job is generally depicted with two valves 12 and 14 of a Christmas tree 15, two valves 16 and 18 of a fracing tree 19, and a connector 20. The connector is shown with a cover 22, operating valve 24, and hydraulic supply port 26, and hydraulic return port 28.

Figure 2:
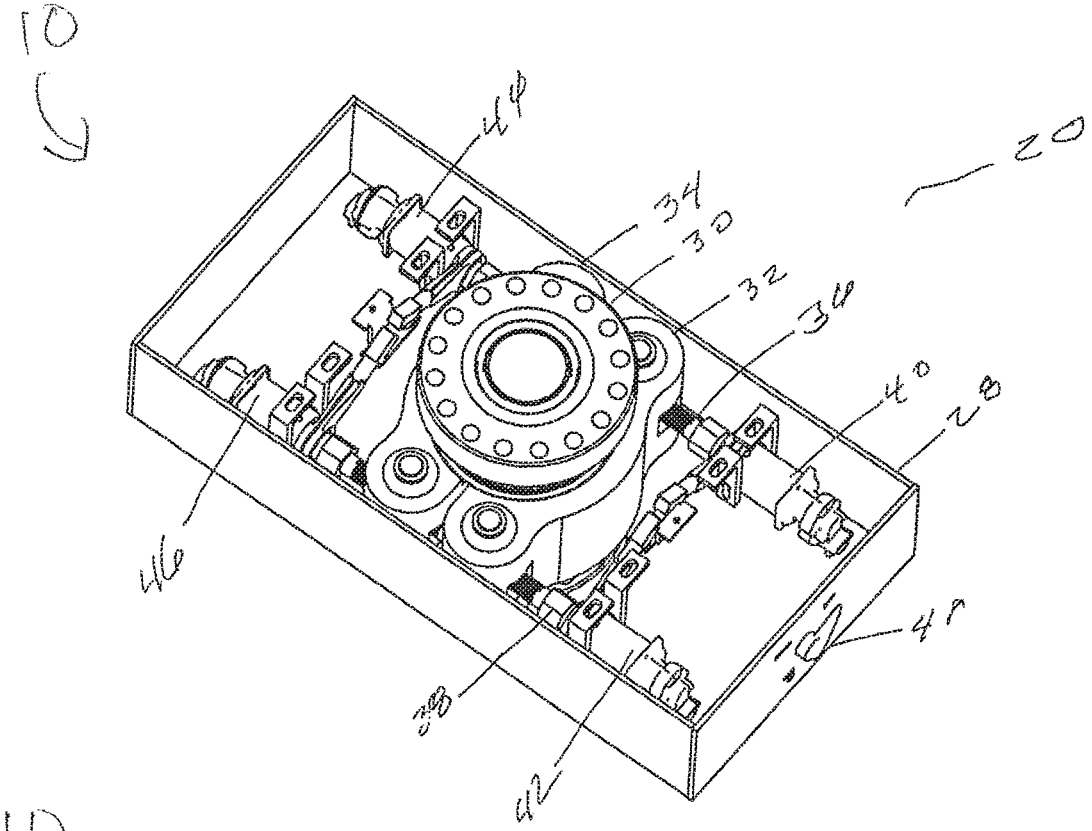
FIG. 2 is generally a perspective view of connector with its top cover portion of cover removed with the clamp segments in the engaged position in accordance with a preferred embodiment of the current invention.

Referring now to FIG. 2, a perspective view of connector 20 is shown with its top cover portion of cover 22 removed showing top flange 30, clamp segments 32 and 34 in actuated position, actuating bolts 36 and 38, motors 40, 42, 44, and 46, and operating valve 48.

Figure 3:
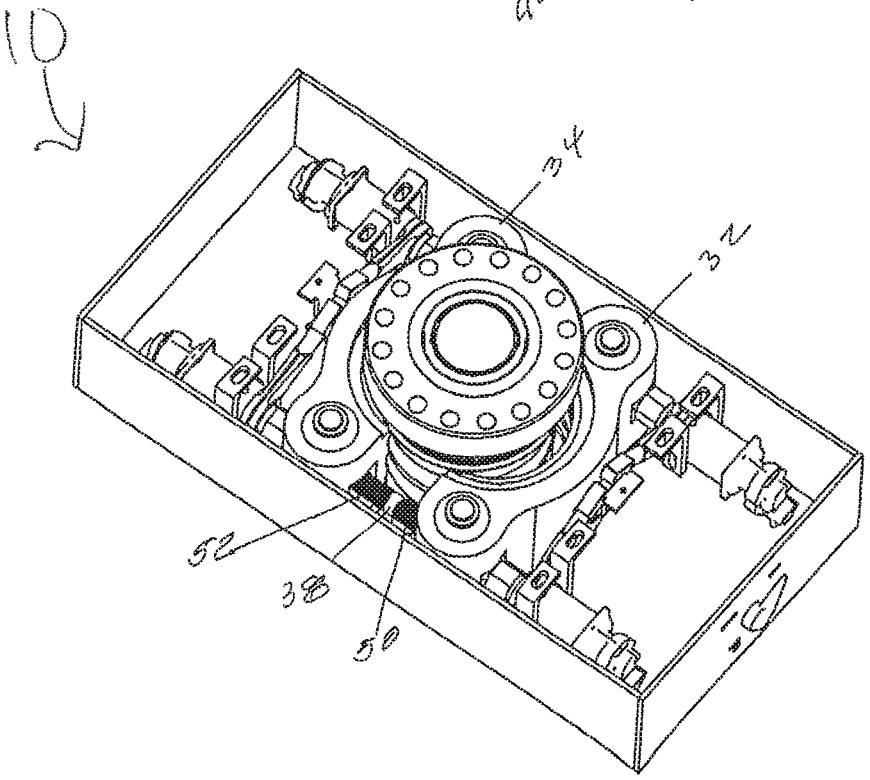
FIG. 3 is generally a similar perspective view as was seen in FIG. 2 with the clamp segments shown in a released position in accordance with a preferred embodiment of the current invention.

Referring now to FIG. 3, a similar perspective view as was seen in FIG. 2 is shown with the clamp segments 32 and 34 shown in the released position. Actuating bolt 38 is shown with a right hand thread 50 engaging clamp segment 32 and a left hand thread 52 engaging clamp segment 34, so that rotation of actuating bolt 38 in one direction will bring clamp segments 32 and 34 closer together and rotation in the opposite direction will move them away from each other.

Figure 4:
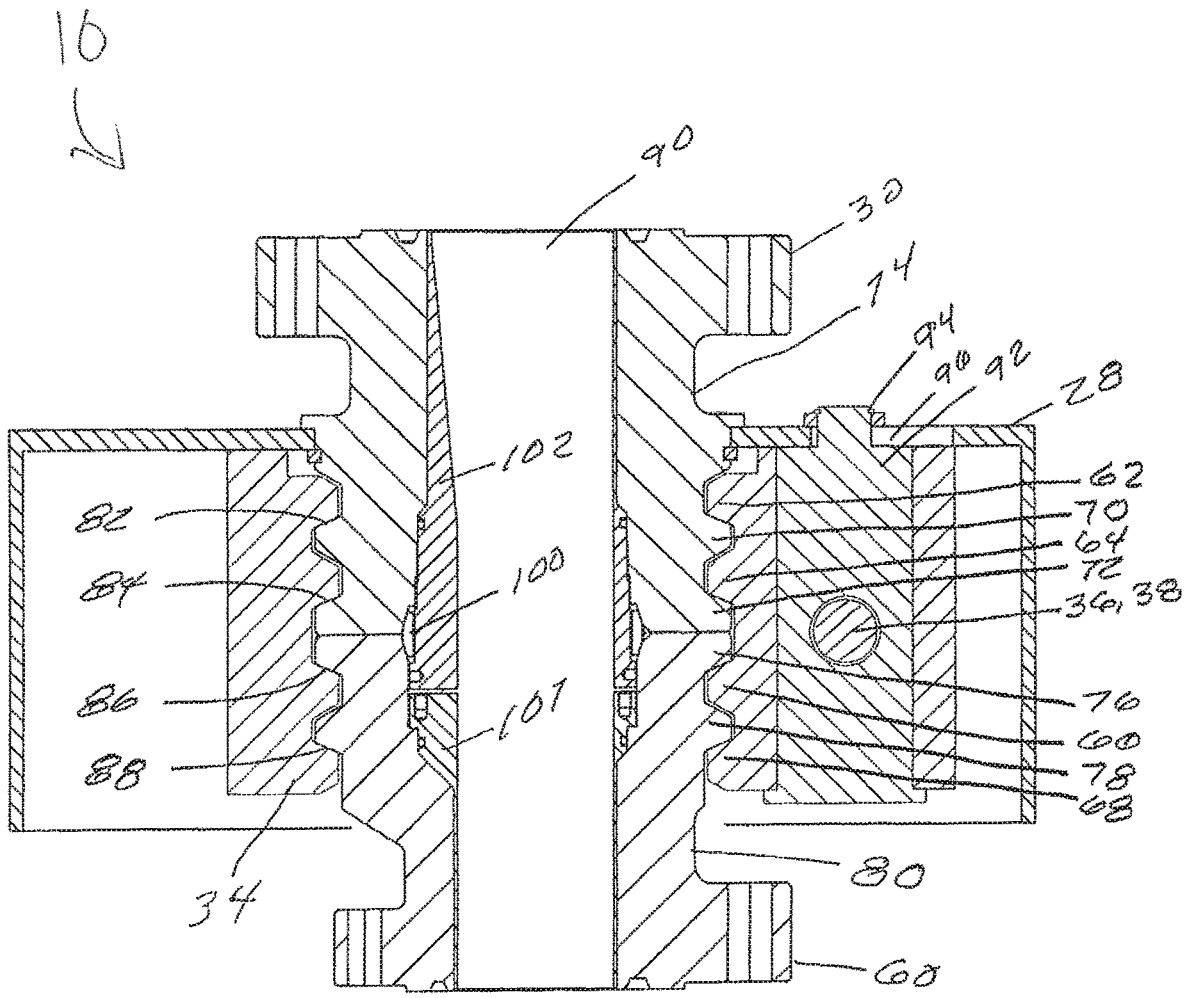
FIG. 4 is generally a section view shown a taken along lines "A-B" of FIG. 5 in accordance with a preferred embodiment of the current invention.
Figure 5:
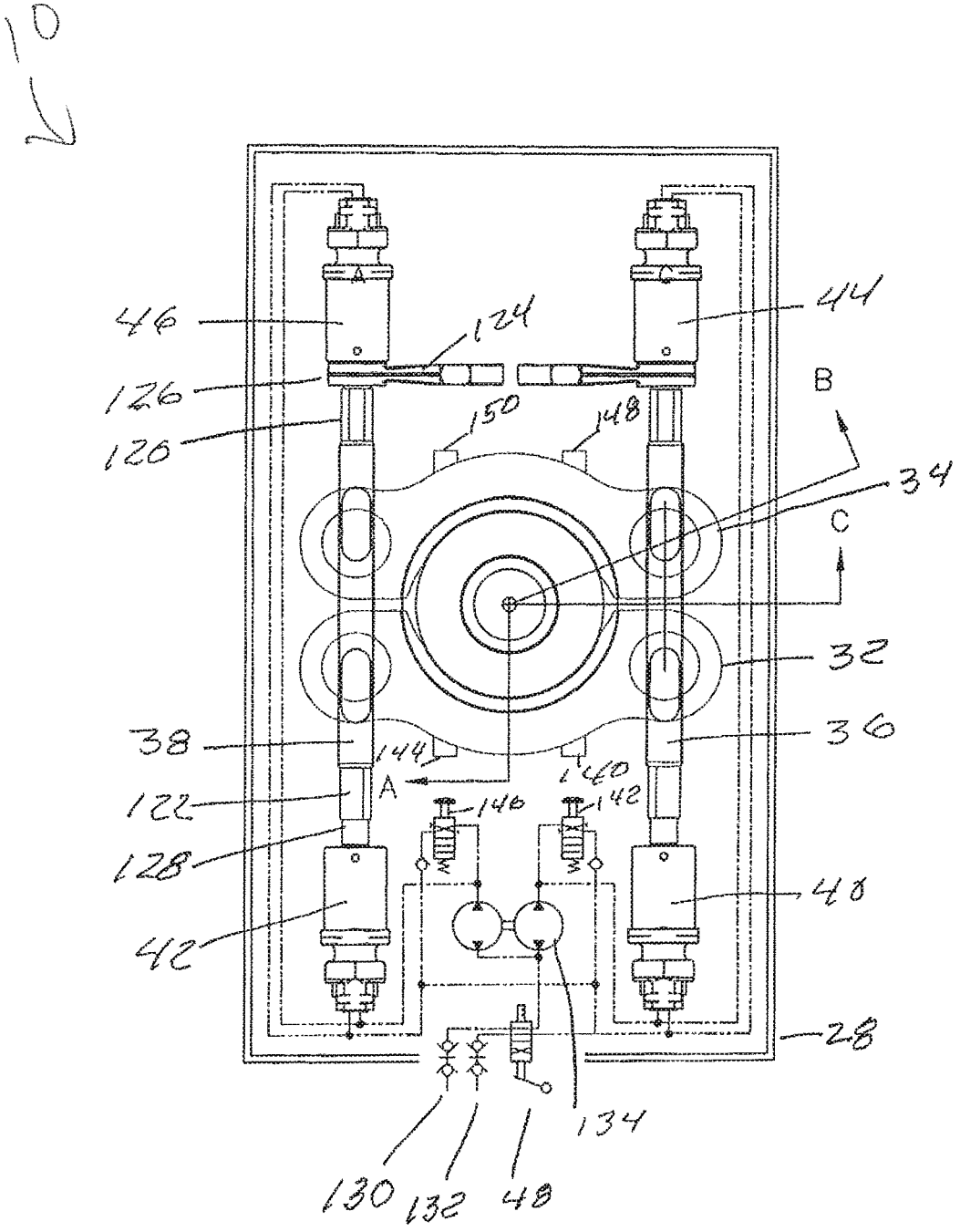
FIG. 5 is generally a top view showing a connector with the top of the cover removed in accordance with a preferred embodiment of the current invention.

Referring now to FIG. 4, a section view is shown taken along lines "A-B" of FIG. 5 showing top flange 30 and bottom flange 60, each of which are shown as standard API bolted flanges but can be clamp hubs or other profiles. Clamp segments 32 and 34 are shown to have protrusions 62, 64, 66 and 68, which engage protrusions 70 and 72 on connector body 74 and protrusions 76 and 78 on mandrel 80.

Connector body 74 may be bolted to the fracing tree 19 and mandrel 80 may be bolted to Christmas tree 15 as seen in FIG. 1. It is understood that connector body 74 and mandrel 80 may be respectively attached to fracing tree and Christmas tree 15 by other means such as but not limited to removable bolts, permanent fixation, welding, and so forth. It is also understood that numerous configurations of bolting may be utilized.

Contact interfaces 82, 84, 86 and 88 are loaded as clamp segments 32 and 34 are moved inwardly to offset the axial loading, which will result from fluid pressure within the bore 90. Pivot pins 92 work with actuating bolts 36 and 38 to bring clamp segments 32 and 34 closer to one another and are supported by retaining rings 94 in slots 96 in cover 22.

Seal ring 100 is provided to seal between connector body 74 and mandrel 80, and is retained in place by connector body bore protector 102, which engages connector body 74 by thread 104, and thereby retains seal ring 100 in place during assembly. Mandrel bore protector 106 is held in place by gravity, as this will characteristically be a vertical connection. The bore 90 the right side of center in FIG. 4 illustrates an assembly where the bore 90 the frac tree 19 and the Christmas tree 15 are the same. The bore 90 the left side of center in FIG. 4 illustrates an assembly where the bore of the frac tree 19 is larger than the bore 90 of the Christmas tree 15.

Referring now to FIG. 5, connector 20 is generally shown from the top view with the top of the cover 22 removed. The top half of the view shows the motors 44 and 46 engaging the ends of actuating bolts 36 and 38. Hex 120 on actuating bolt 38 is intended to be engaged by wrench 122. Cylindrical portion 126 is intended for allowing wrench 124 to be located around it and be disengaged from actuating bolt 38 such that the actuating bolt 38 can be freely operated by motors 42 and 46. Wrench 124 is presently shown in a stowed position and latched in place by appropriate means. Both ends of actuating bolts 36 and 38 have similar profiles and wrenches.

The lower side of FIG. 5 shows operating valve 48 and hydraulic supply connector 130 and hydraulic return connector 132. In the position of operating valve 48 as shown the supply fluid is directed to a flow divider 134 of a positive displacement type such as gear sections and then to the opening side of the motors 40, 42, 44 and 46.

The general purpose of the flow divider 134 is to cause the motors 40, 42, 44 and 46 to run at the same speed so that one actuating bolt does not get ahead of the other and bind the assembly. In addition to that, specifically when the high torque is being released from the actuating bolts at initial breakout, if one starts to move first it will require lower pressure to move and so will accept all the flow, assuring the unit will bind. With positive displacement flow divider 134 in place the opposite will happen, or when one loses its ability of hole pressure due to being released, all the pressure will be directed to the unreleased side assuring it will release also. In this process, they may come to the open position slightly out of timing. If we presume actuating bolt 36 released first and is slightly ahead, when pad 140 on clamp segment 32 hits valve 142, pressure directed from that side of the flow divider 134 will be vented and motors 40 and 44 will be stopped. Motors 42 and 46 will continue until pad 144 on clamp segment 34 hits valve 146 and similar venting occurs. At this time, the actuating bolts 36 and 38 will be properly timed again. For manufacturing convenience, pads 148 and 150 will exist on clamp segment 34 also, but duplicate vent valves will not be required.

In FIG. 5 the clamp segments 32 and 34 are illustrated in the fully made up or engaged position. It is understood that multiple forms of configuration are contemplated and the illustration should not be considered to limit the invention to such.

Figure 6:
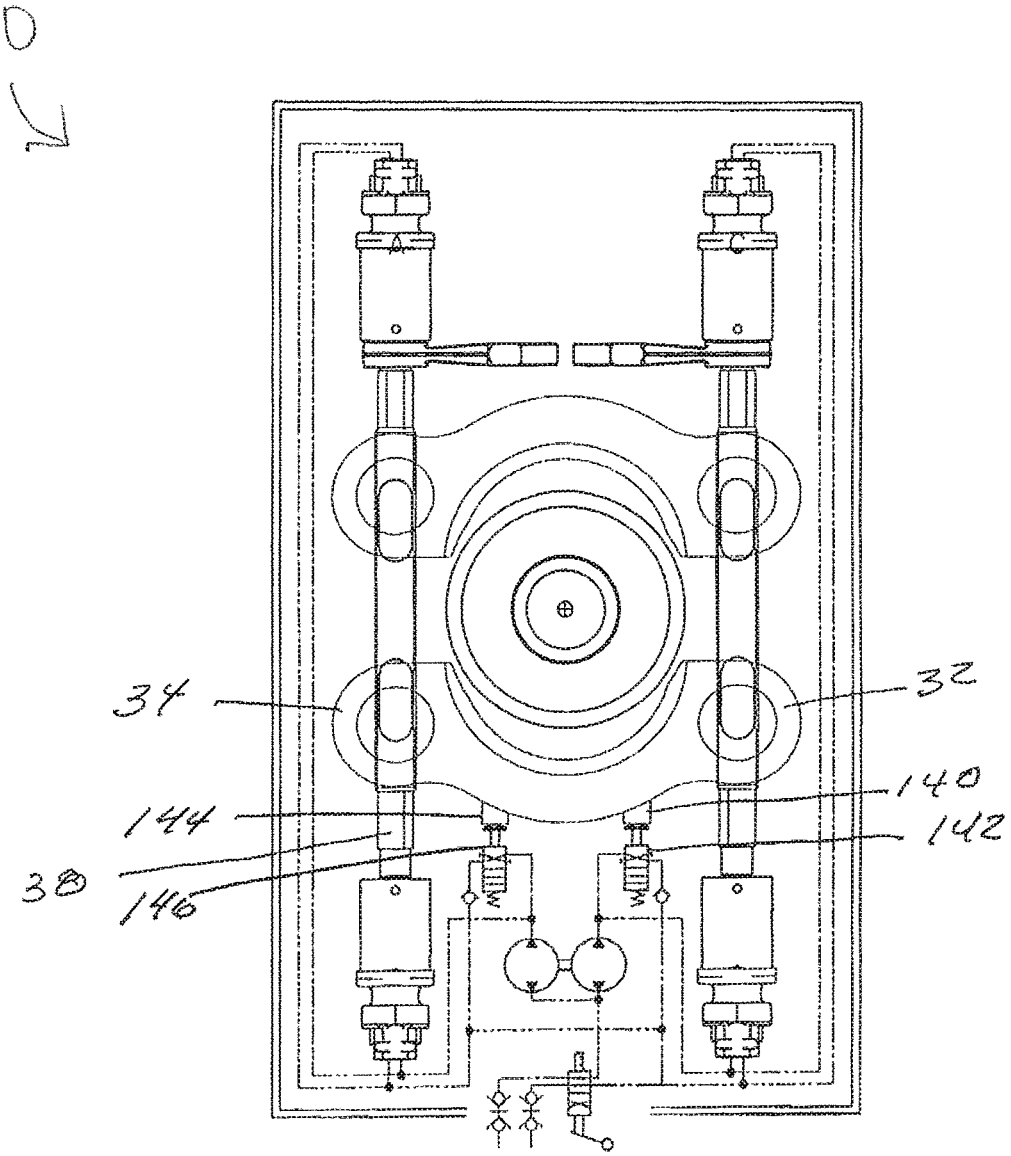
FIG. 6 is generally a similar view to FIG. 5 shown with the clamp segments fully open or disengaged such that the upper and lower portions of the connector can be separated in accordance with a preferred embodiment of the current invention.

Referring now to FIG. 6, a similar view to FIG. 5 is shown with the clamp segments 32 and 34 shown fully open or disengaged such that the upper and lower portions of the connector can be separated. Pads 140 and 144 have contacted valves 142 and 146 so the actuating bolts 36 and 38 as well as clamp segments 32 and 34 have been stopped in the desired location.

Figure 7:
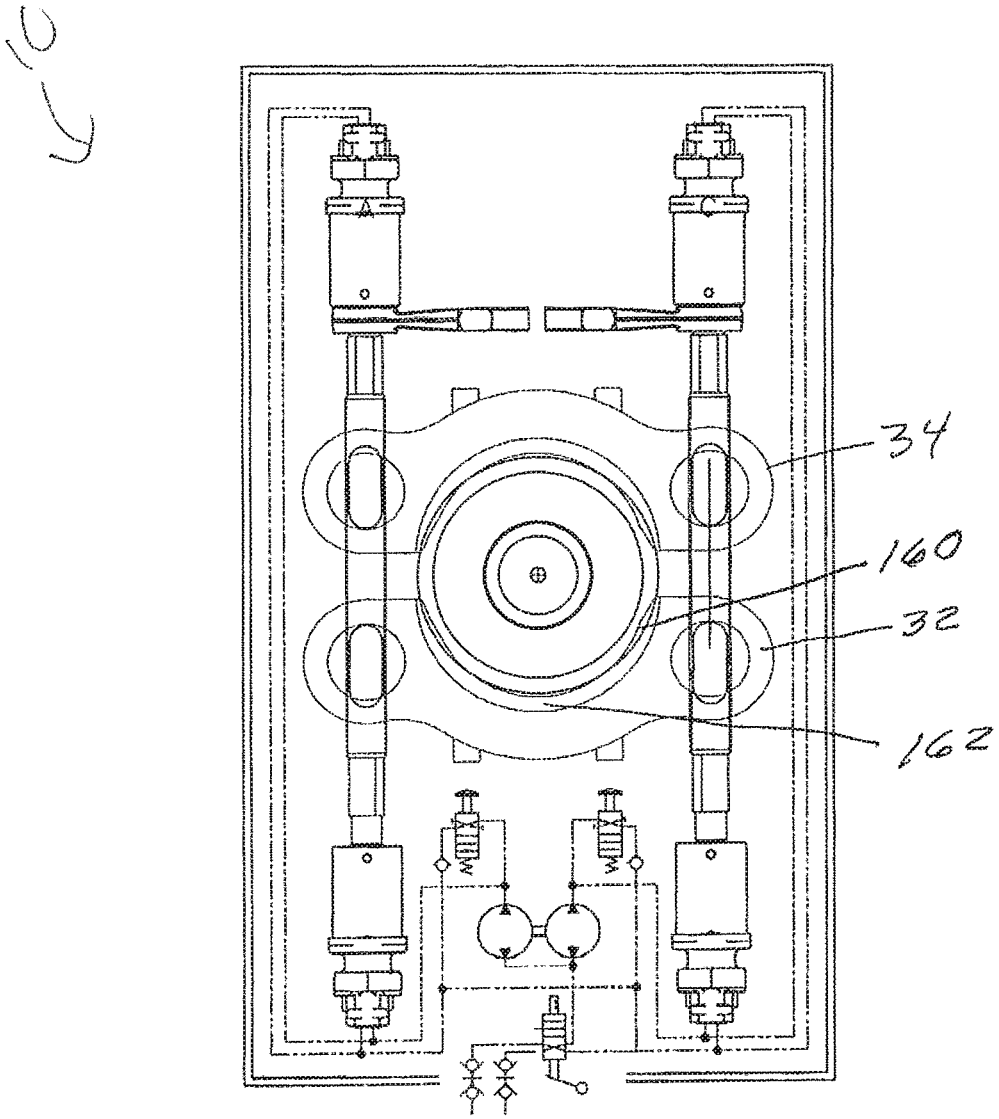
FIG. 7 is generally a similar view to FIGS. 5 and 6 shown at a step intermediate to that shown in FIG. 5 and FIG. 6 during the makeup or engagement process in accordance with a preferred embodiment of the current invention.

Referring now to FIG. 7, a similar view to FIGS. 5 and 6 is shown at a step intermediate to that shown in FIG. 5 and FIG. 6 during the makeup or engagement process. At this point, it can be seen that there is more engagement at location 160 and at location 162. It is characteristic in this type of clamp hub engagement that contact is first made at location 160. Contact interfaces 82, 84, 86 and 88 are characteristically at a twenty-five-degree angle of engagement to the plane of movement of clamp segments 32 and 34 so a substantial wedging action occurs at point 160. All engagement force or preloading which is to occur at location 162 may first pass through the wedging action at location 160 to get to location 162. This means that the preloading at location 162 will be reduced by the amount of wedging preloading at location 160, giving highly irregular preloading. In this field, this is often offset by impacting the center back of clamp segments with a sledgehammer to try to drive it to a more uniform loading.

Figure 8:
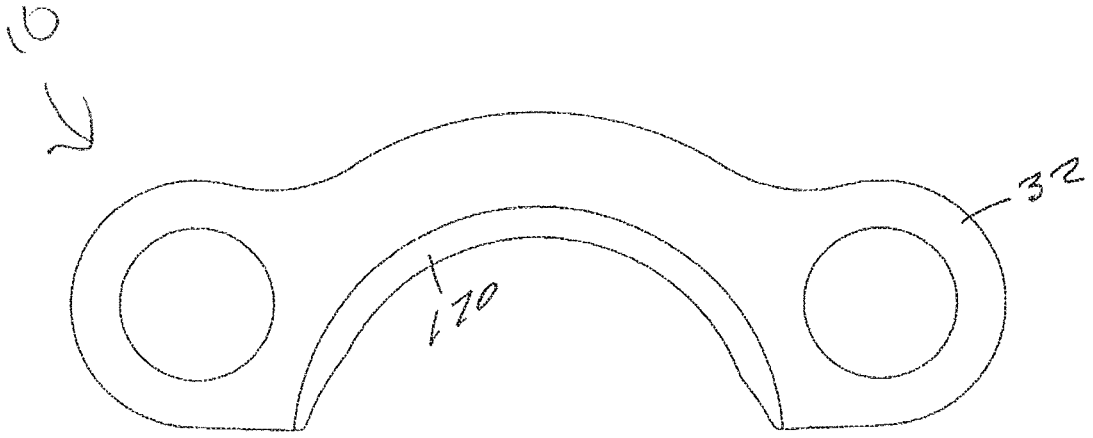
FIG. 8 is generally a view of a clamp segment in an ideal made up condition in accordance with a preferred embodiment of the current invention.
Figure 9:
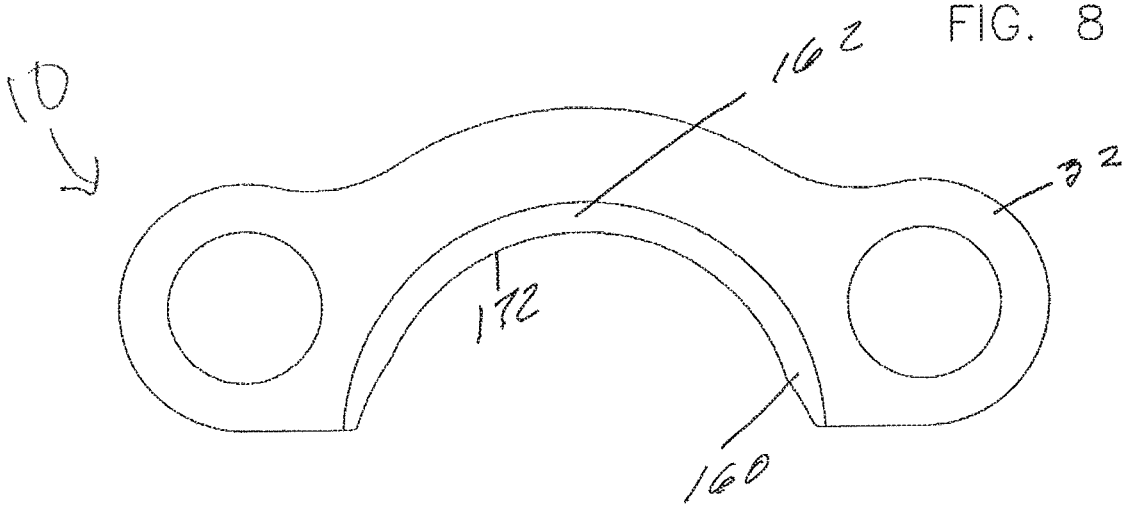
FIG. 9 is generally a view similar to FIG. 8 showing the machine's shape to achieve the shape of FIG. 8 when made up in accordance with a preferred embodiment of the current invention.

Referring now to FIGS. 8 and 9, two drawings are seen, which look very similar. FIG. 8 shows the radius 170 of the clamp segment 32 as what it will be when made up to the ideal preloading or in other words at the exact same radius as the mating profiles on connector body 74 and mandrel 80. This is not a profile typically achieved on clamp hub designs. FIG. 8 shows how clamp segment 32 is to be machined with radius 172, which is slightly larger than radius 170. By having radius 172 slightly larger than radius 170, engagement will first occur at location 162 of FIG. 7 and clamp segment will effectively be bent to radius 170. In this way, the preload force delivered to location 162 will be the sum of the bending force plus the force passed through the wedging action at location 160. In this way, a simple bolt makeup can result in a highly uniform preload around the circumference of the profiles.

Figure 10:
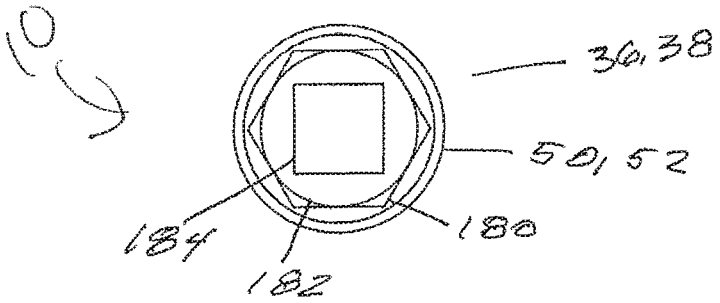
FIG. 10 is generally an end view of actuating bolt in accordance with a preferred embodiment of the current invention.

Referring now to FIG. 10, an end view of actuating bolt 38 is shown with right hand thread 50 and left hand thread 52 hex 180 prepared for torque engagement by wrench 124, cylindrical portion 126 to allow for free rotation within wrench 124, and square drive for accepting drive from motor 46. Motor 46 can be of air, hydraulic, or electric style and can be simple direct actuation, impact type actuation, or a combination of the two.

Figure 11:
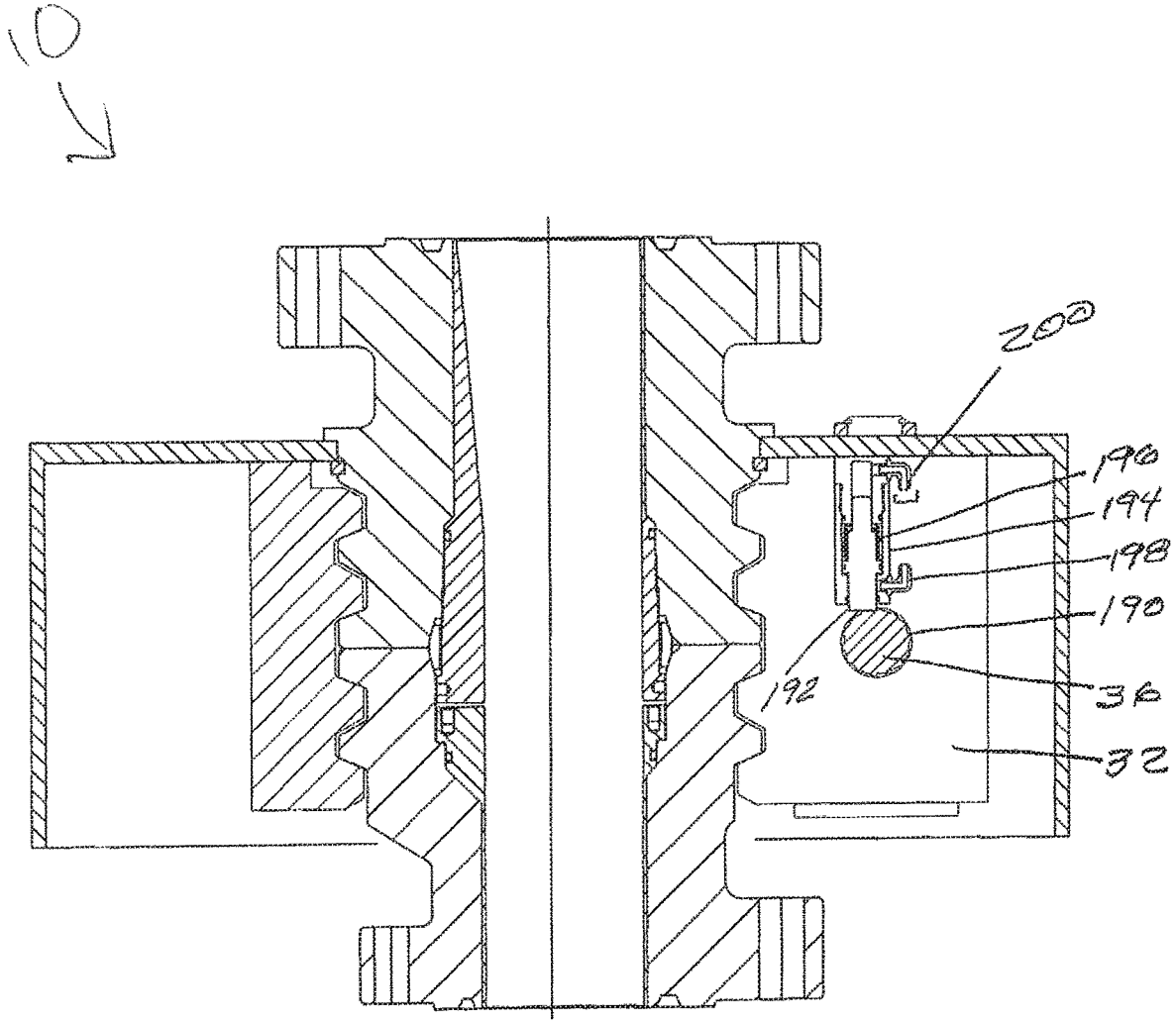
FIG. 11 is generally a section view showing a secondary locking mechanism for an actuating bolt in accordance with a preferred embodiment of the current invention.
Figure 12:
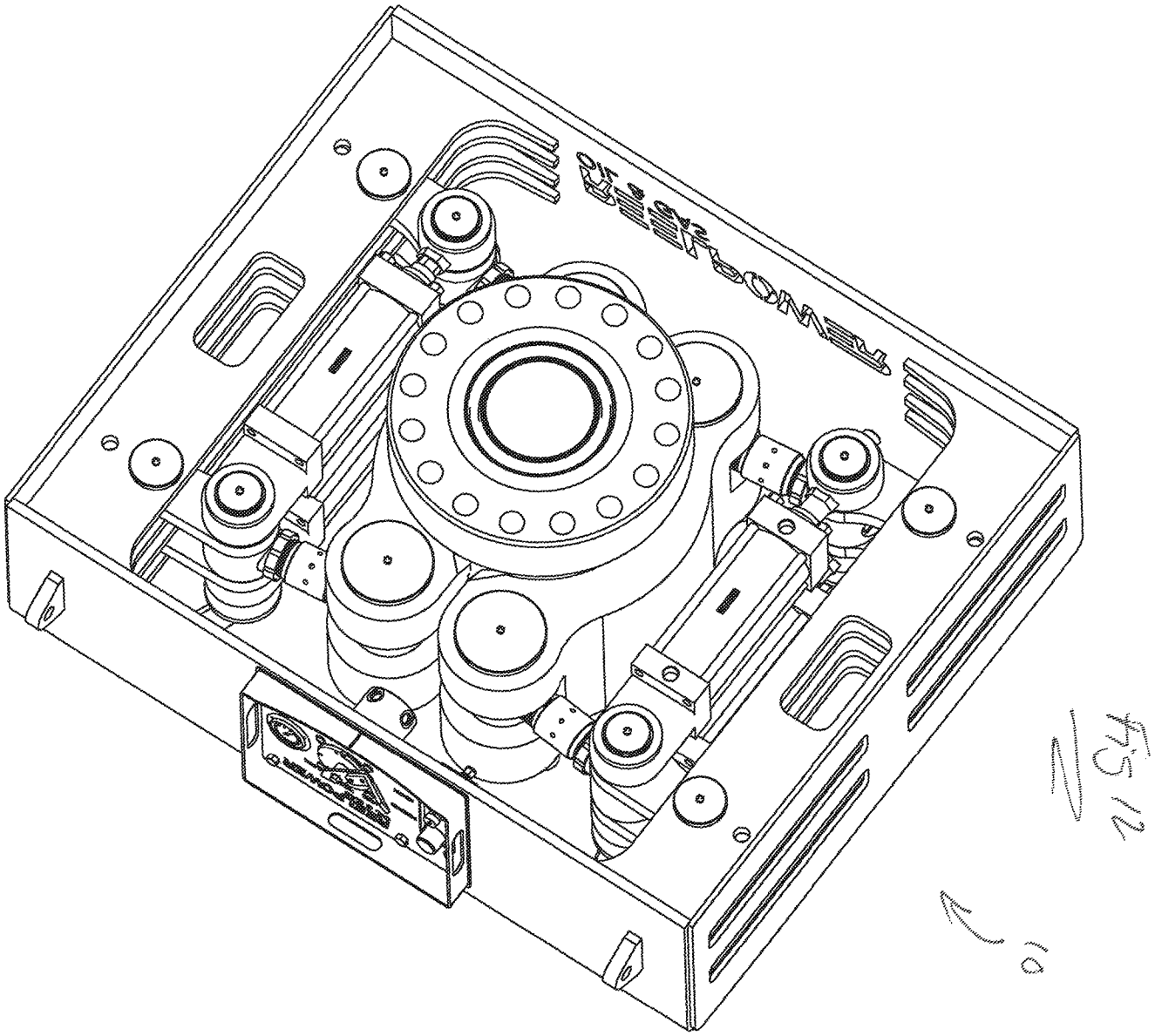
Figure 13:
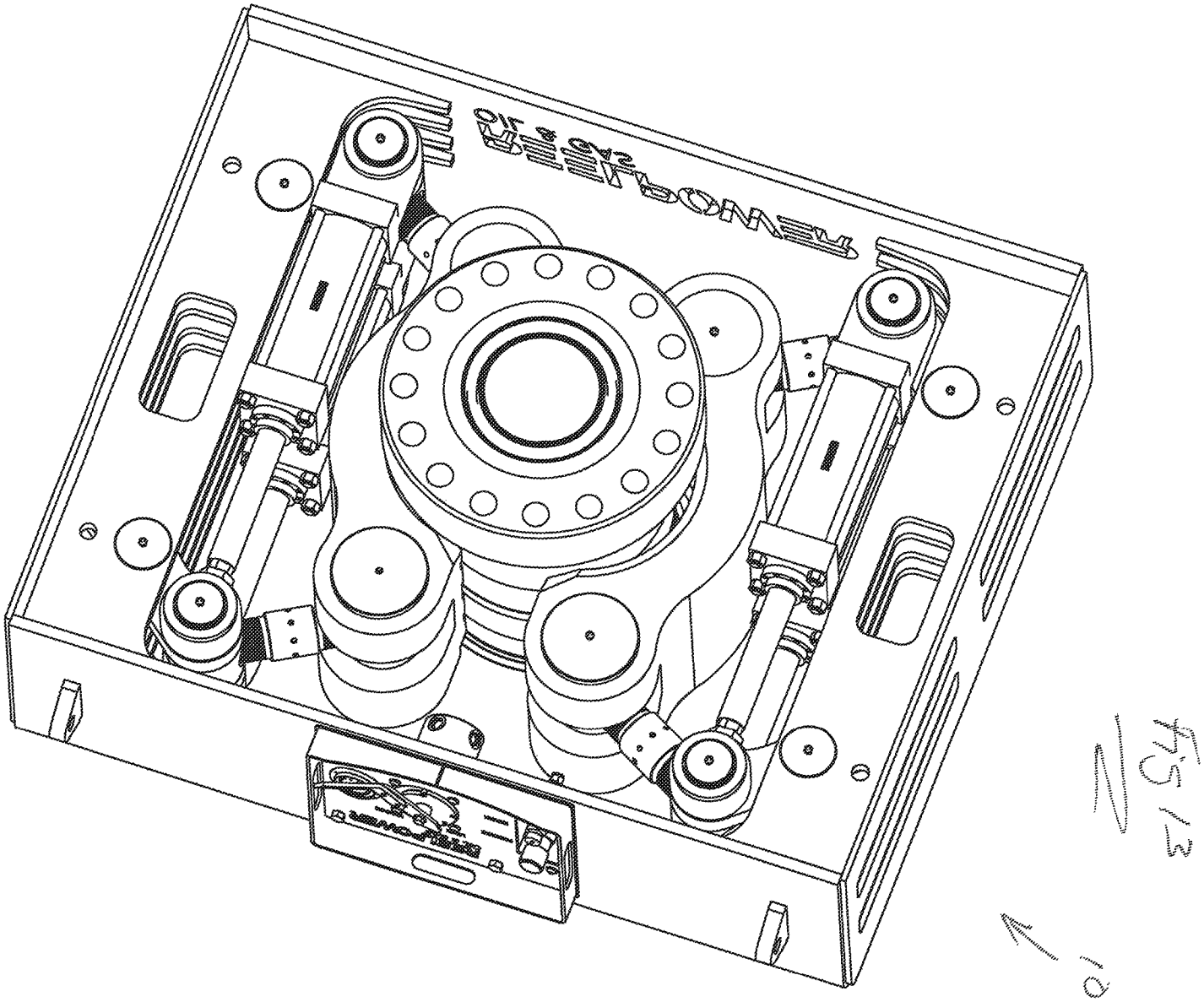
Figure 14:
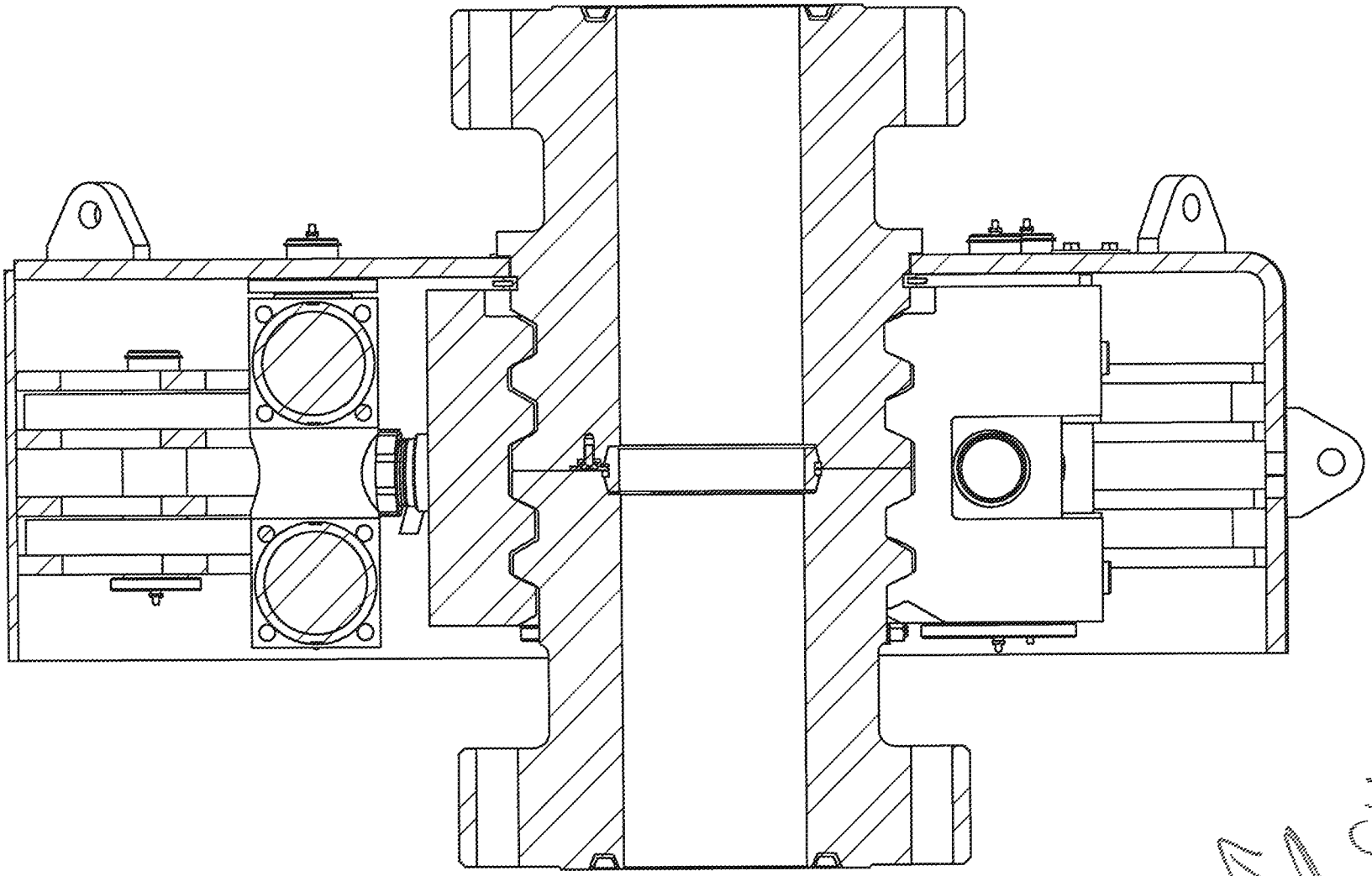
Figure 15:
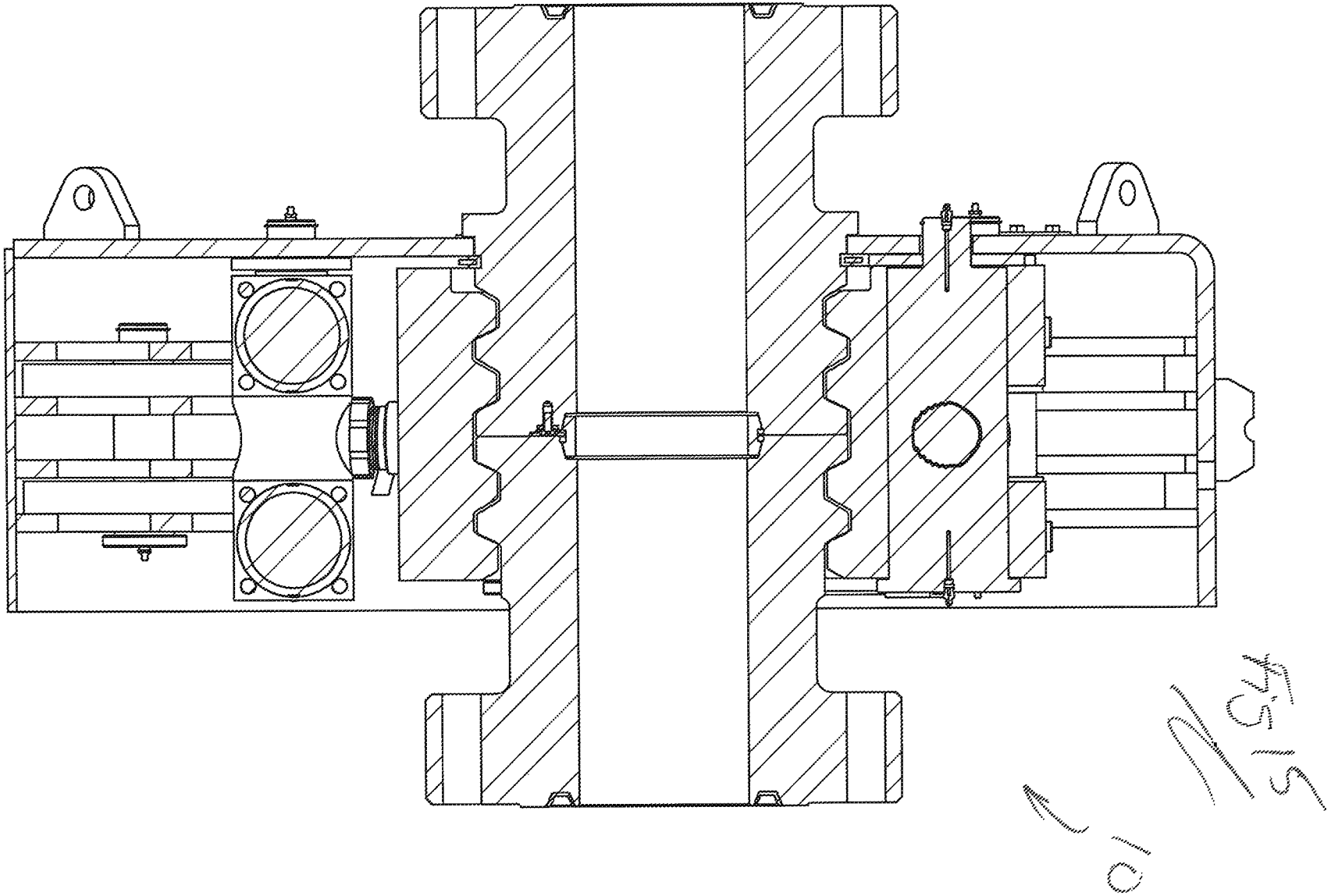
Figure 16:
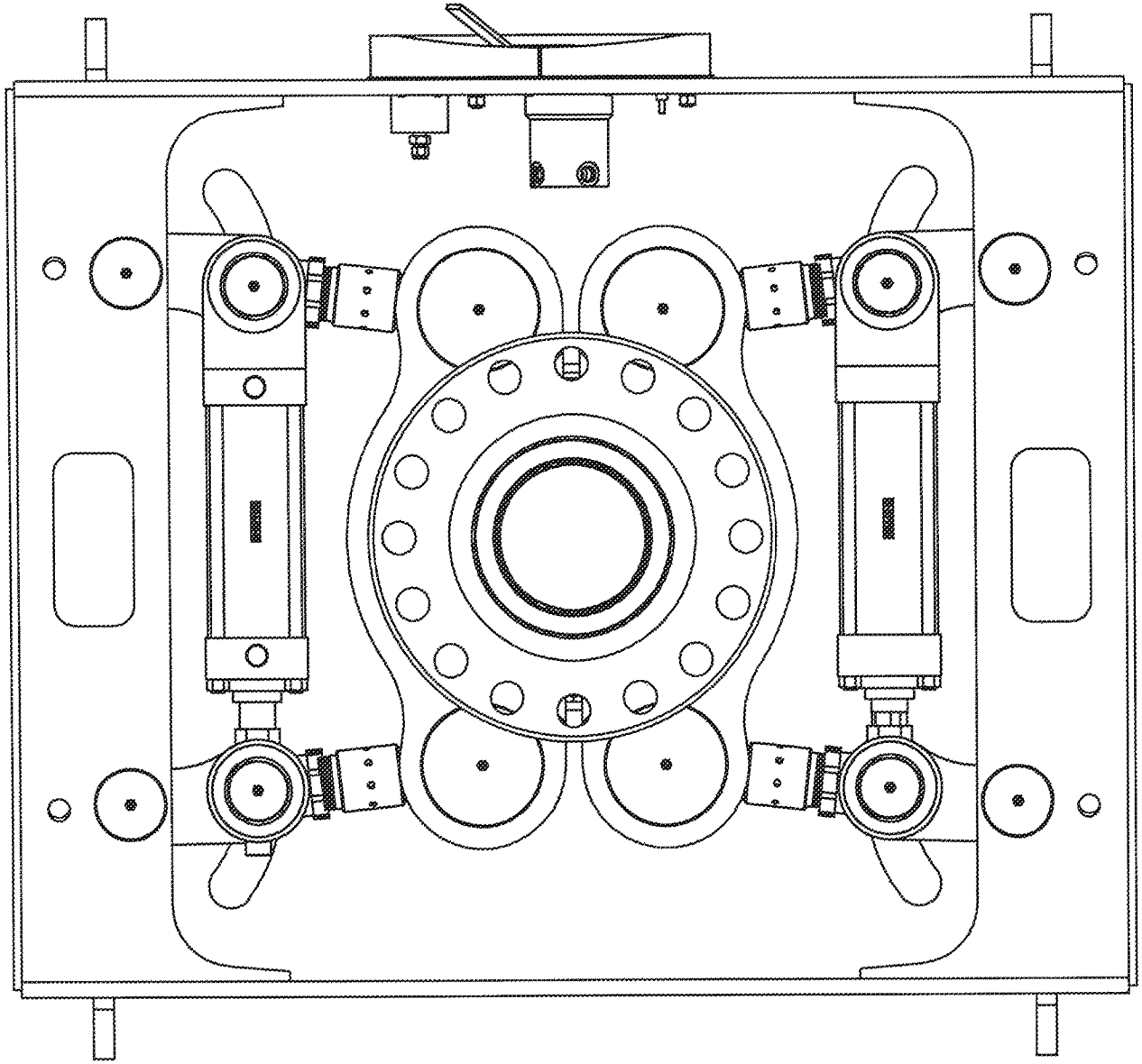
Figure 17:
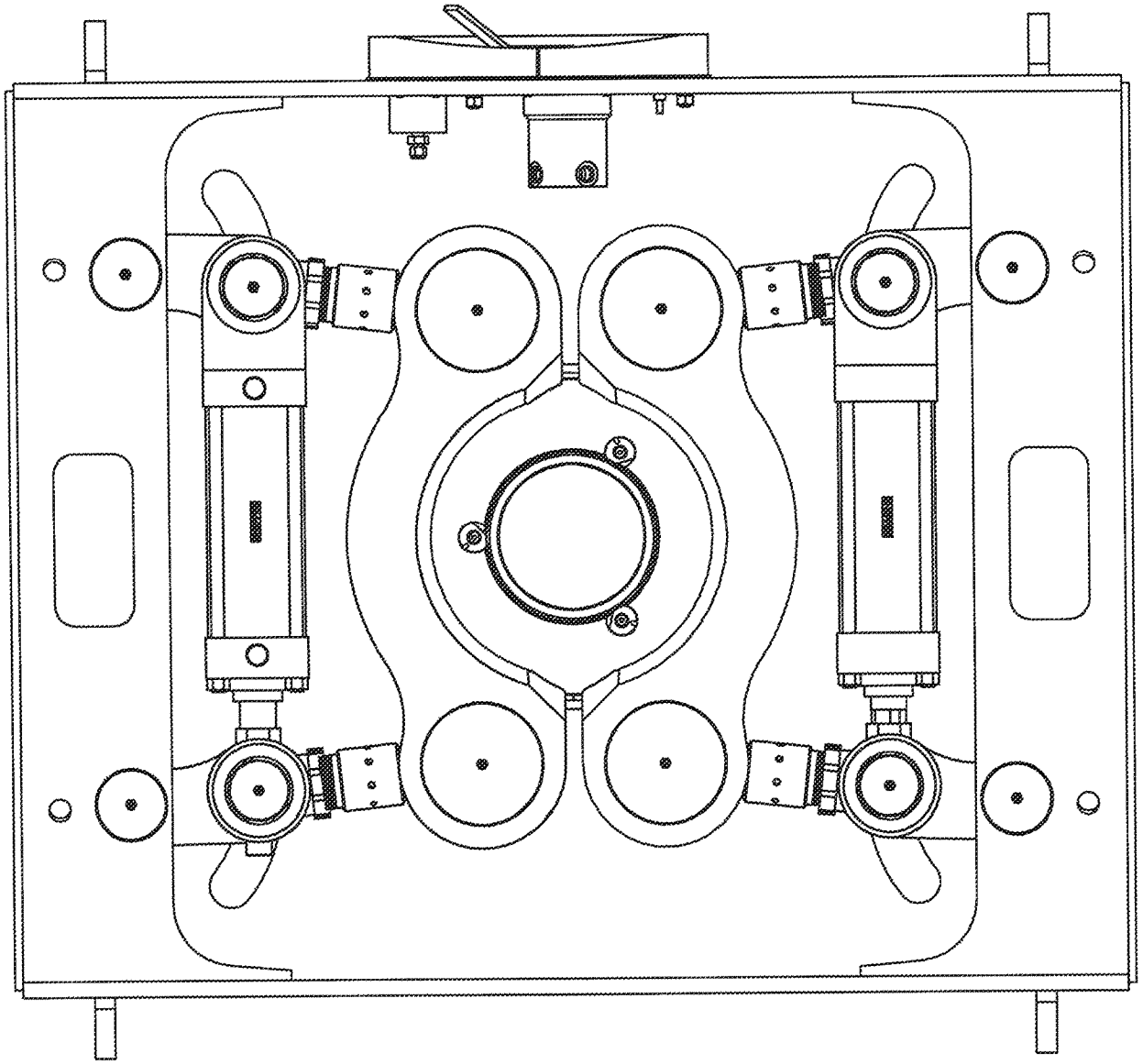
Figure 18:
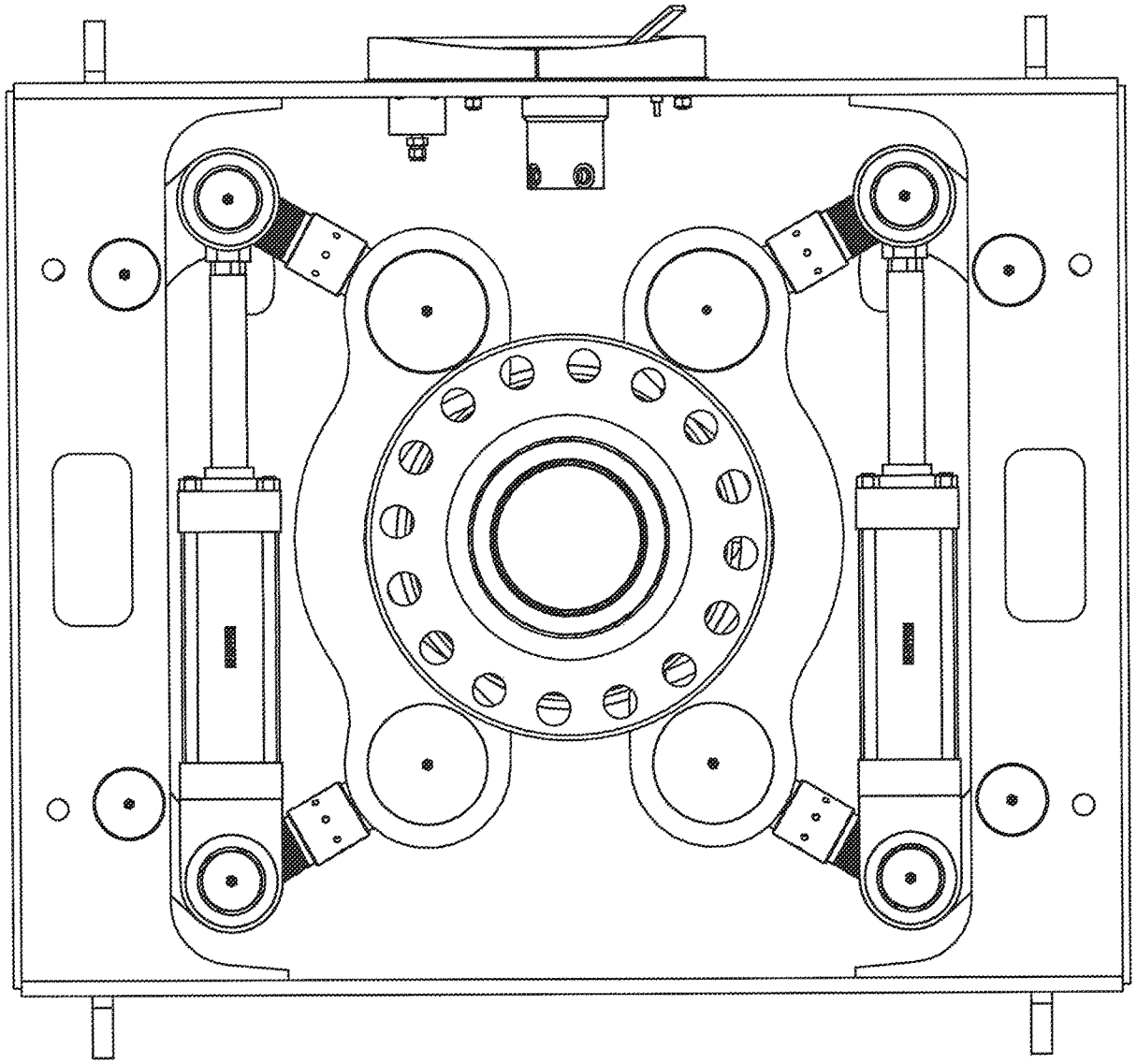
Figure 19:
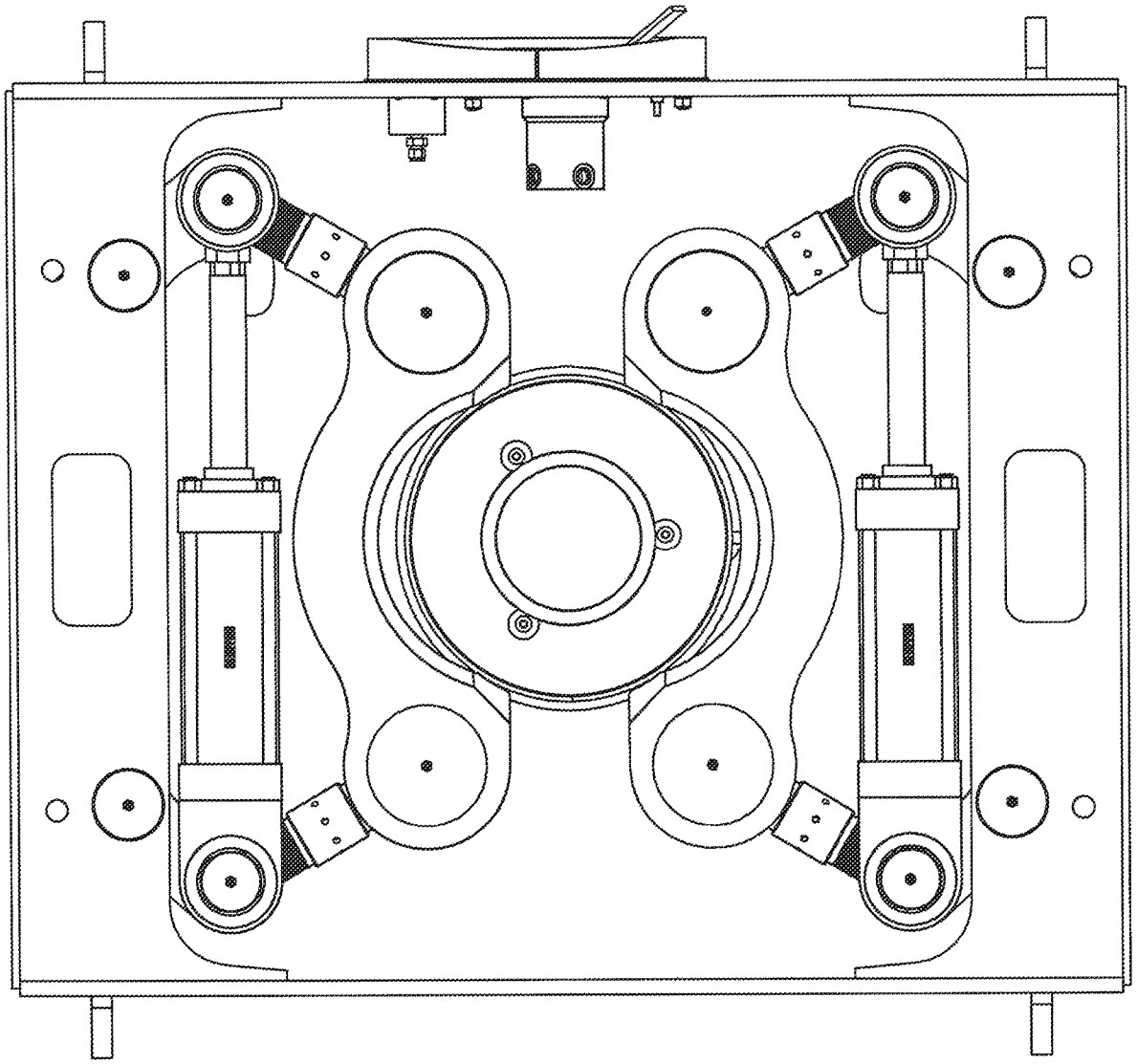
Figure 8:
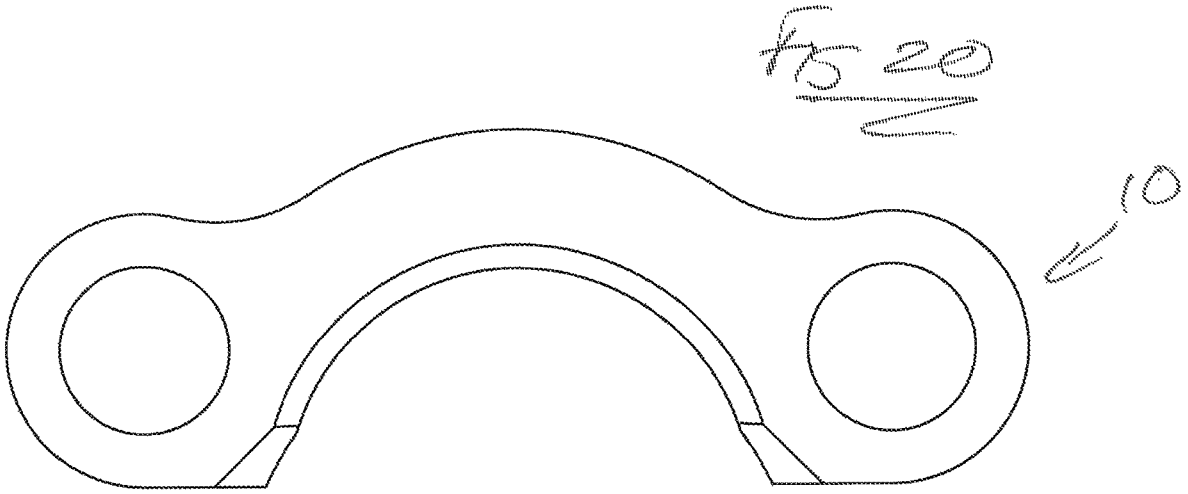
Figure 9:
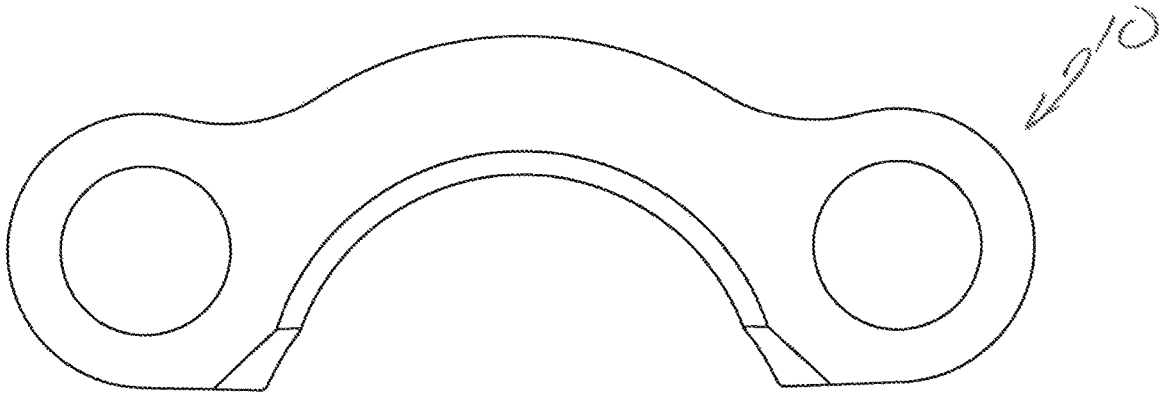
Figure 21:
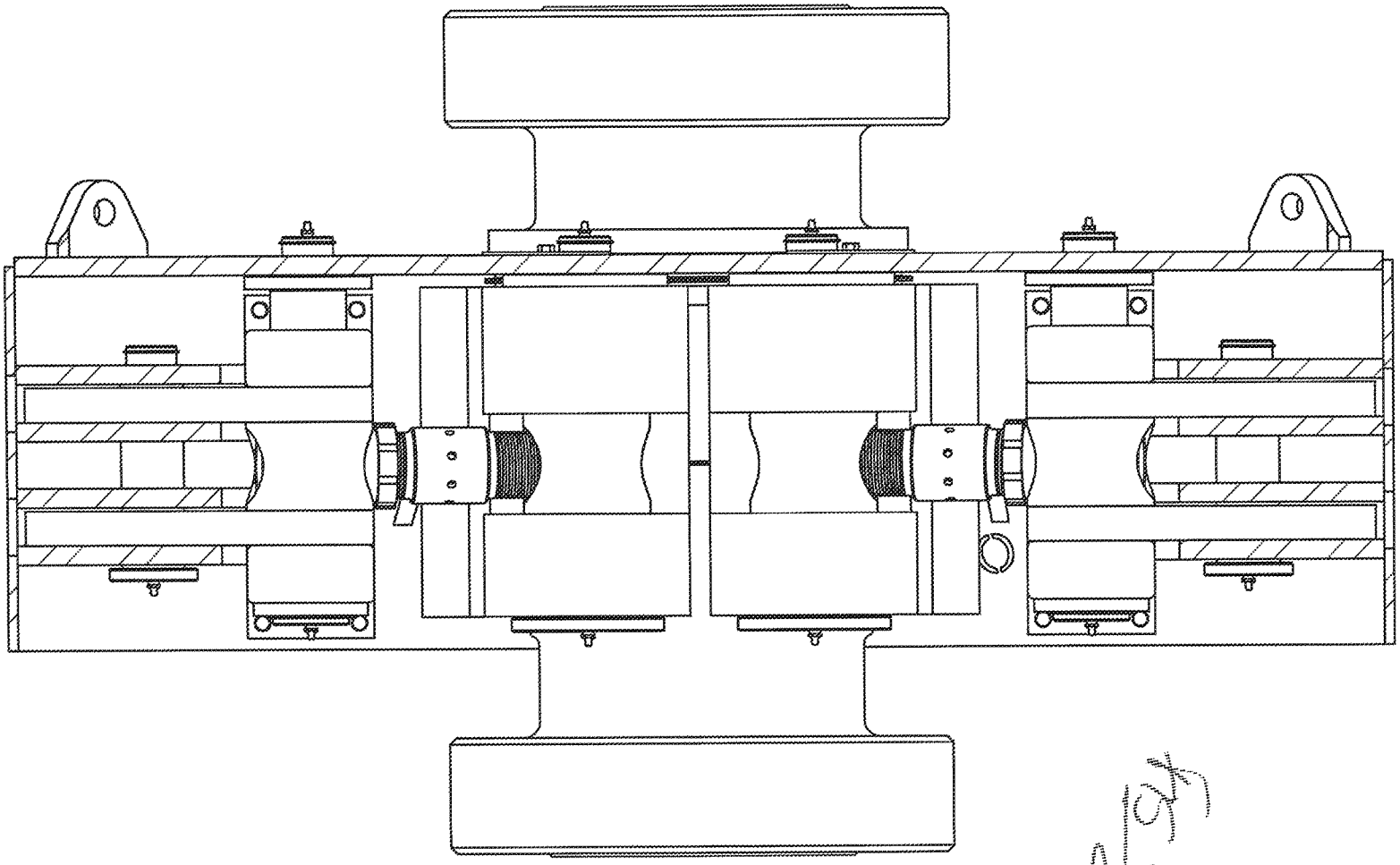
Figure 22:
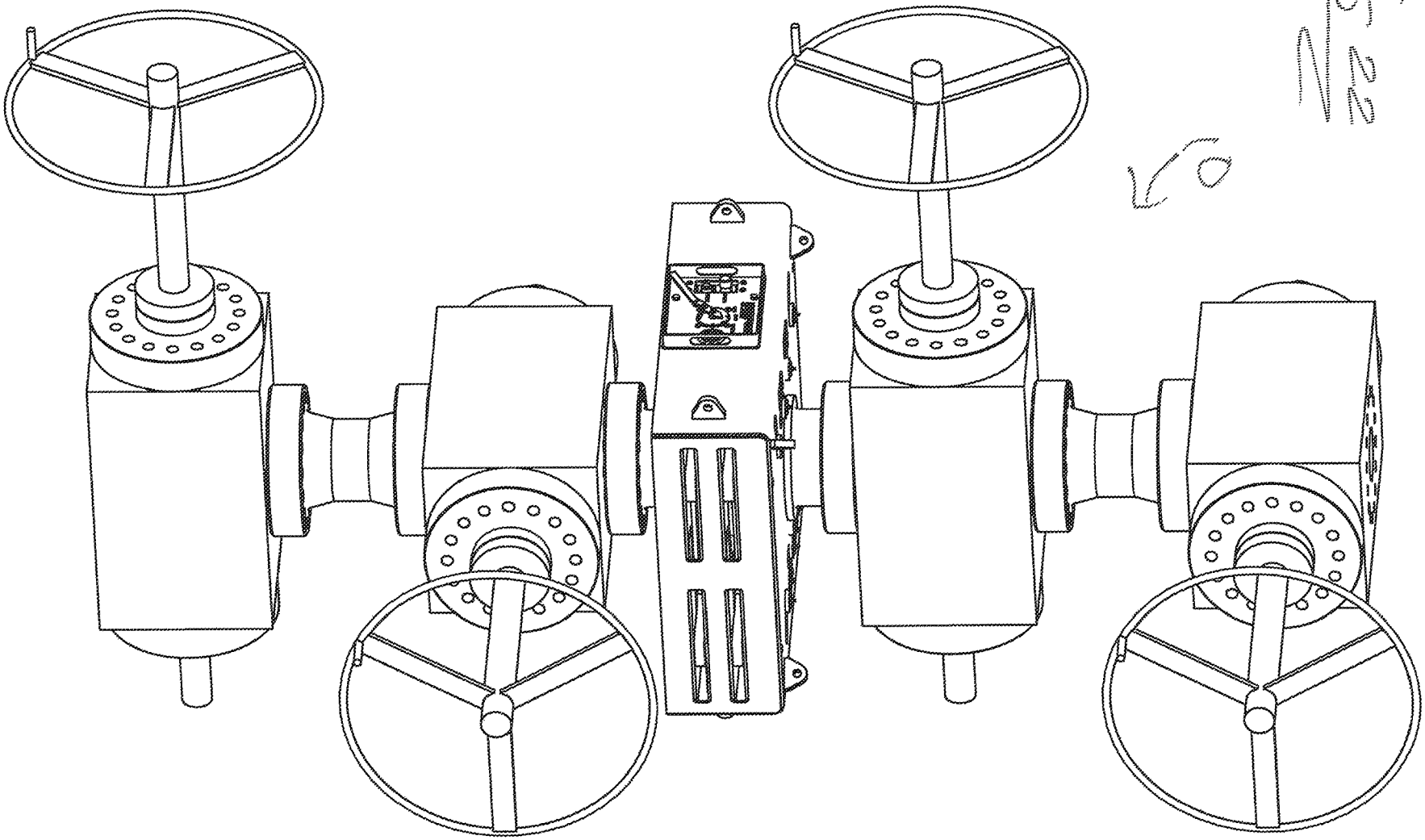
Figure 23:
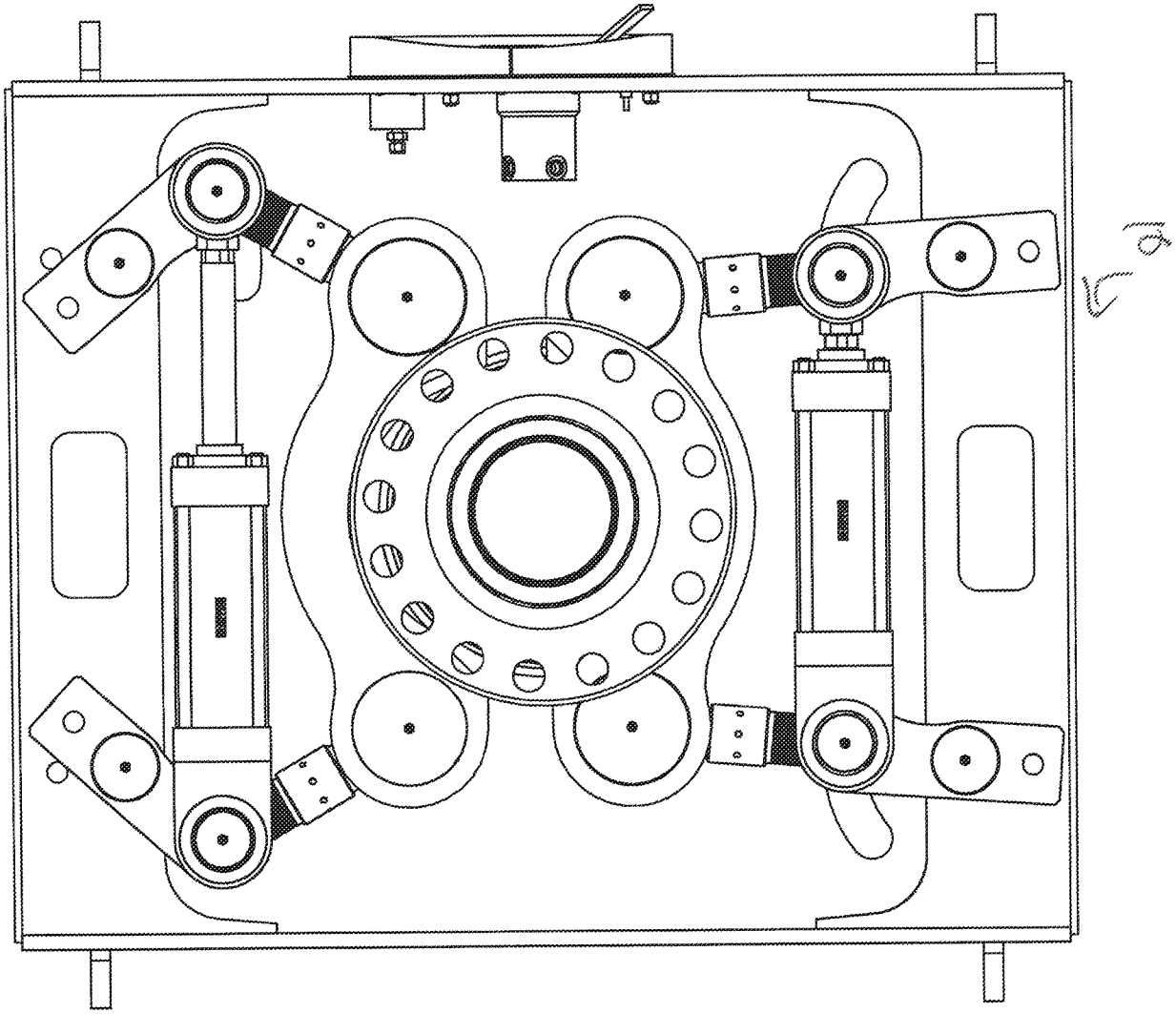
Figure 24:
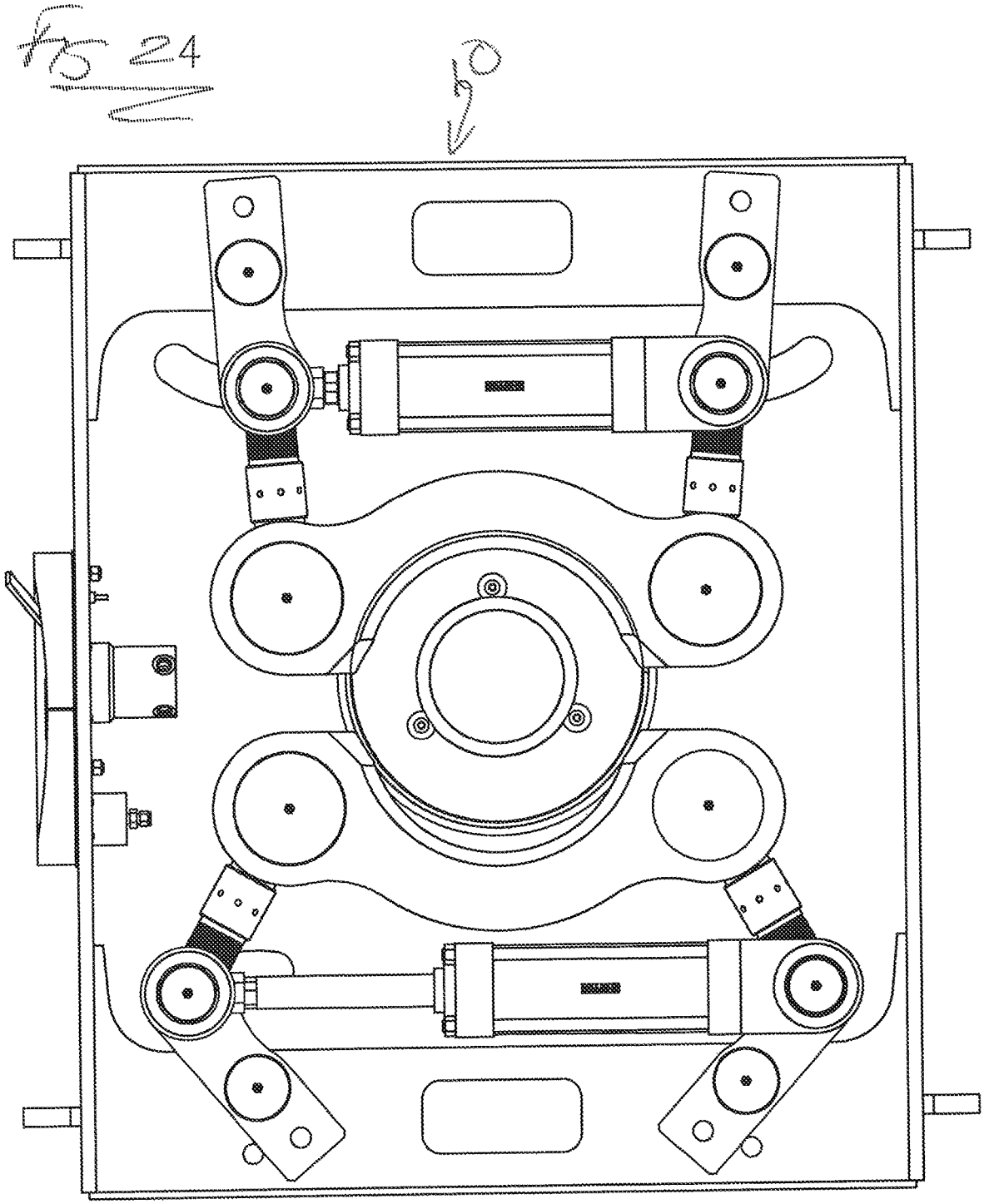

Referring now to FIG. 11, a portion of actuating bolt 36 is shown with a ratchet profile 190 machined around its circumference. Ratchet dog 192 is shown in cylinder 194 and is loaded by spring 196 down into engagement with the ratchet profile 190. Hydraulic connection 198 is connected to the opening circuit of the connector 20 such that when opening pressure is delivered to motors 40, 42, 44 and 46, the ratchet dog 192 is automatically released. The opposite side of cylinder 194 is simply vented as shown at 200. This ratchet mechanism may act as a secondary method of preventing the actuation bolts 36 and 38 from releasing under the vibratory conditions of the fracing operations.

Another Preferred Embodiment Invention 10 also contemplates that hydraulically actuated cylinders may be utilized instead of torque wrench 124. It is contemplated to change the actuation from being hydraulically powered torque wrenches to hydraulically actuated cylinders that drive linkages that then move the clamp halves. This may allow for the linkages to "lock over center" such that force must be applied to the cylinders for the clamp to be disengaged The particular embodiments disclosed above are illustrative only, as the invention may be modified and practiced in different but equivalent manners apparent to those skilled in the art having the benefit of the teachings herein. Changes may be made in the combinations, operations, and arrangements of the various parts and elements described herein without departing from the spirit and scope of the invention. Furthermore, names, titles, headings and general division of the aforementioned are provided for convenience and therefore, should not be considered limiting.

What is claimed is:

1. A connector for connecting oilfield pressure vessels, comprising:

a connector body;

a mandrel body;

two or more clamp segments;

two or more actuating bolts;

a seal ring to provide sealing engagement between said connector body and said mandrel body;

one or more motors driving each of said two or more actuating bolts;

control means to reduce or retard the power to the first of said two or more actuating bolts to release and prevent its further movement until the other of said actuating bolts release also; and means to detect when actuating bolts reach the end of their anticipated movement in the disengagement mode and stopping further movement and thereby allow the other of said actuating bolts to continue their travel until they all reach the end of their anticipated movement and establish the correct relationship again.

2. The connector of claim 1 further comprising said means to detect a location on said clamp segments contacting a valve.

3. The connector of claim 1 further comprising an interface profile on said clamp segments are machined to a larger radius than the mating interface profile on said clamp hubs such that the loading at the central circumferential portion of said clamp segments is a composite of bending load plus circumferential load.

4. The connector of claim 1 further comprising said actuating bolts provide a shaped portion for the engagement of a manual override wrench and cylindrical portion for disengagement of said manual override wrench without removing said wrench from said actuation bolt.

5. The connector of claim 4 further comprising said shaped portion is a hex.

6. The connector of claim 1 further comprising a ratchet profile on said actuating bolts and a ratchet dog, which allows said actuating bolts to rotate in the engagement direction and prevent their rotation in the disengagement direction.

* * * * *